US007395627B2

(12) United States Patent
La France et al.

(10) Patent No.: US 7,395,627 B2
(45) Date of Patent: Jul. 8, 2008

(54) ACCESSORY MOUNT FOR A FIREARM

(75) Inventors: Timothy F. La France, Newport Beach, CA (US); Michael D. Picciotta, Yorba Linda, CA (US)

(73) Assignee: Surefire, LLC, Fountain Valley ( * ) Notice: Subject to any disclaimer, the term of this patent is extended or adjusted under 35 U.S.C. 154(b) by 321 days.

(21) Appl. No.: 11/394,061

(22) Filed: Mar. 29, 2006

(65) Prior Publication Data

US 2007/0234628 A1 Oct. 11, 2007

(51) Int. Cl.
*F41G 1/35* (2006.01)

(52) U.S. Cl. ..... 42/114; 42/146; 362/110

(58) Field of Classification Search ..... 42/114, 42/115, 116, 117, 142, 146; 362/110, 113, 362/114

See application file for complete search history.

(56) References Cited

U.S. PATENT DOCUMENTS

| | | | |
|---|---|---|---|
| 1,338,239 | A | 4/1920 | Matys |
| 2,450,584 | A | 10/1948 | Dodge |
| 3,584,533 | A | 6/1971 | Allyn |
| 3,901,125 | A | 8/1975 | Raville |
| 4,313,272 | A | 2/1982 | Matthews |
| 4,344,246 | A | 8/1982 | Bauman et al. |
| 4,418,487 | A | 12/1983 | Strahan |
| 4,542,447 | A | 9/1985 | Quakenbush |
| 4,777,754 | A | 10/1988 | Reynolds, Jr. |
| 4,856,218 | A | 8/1989 | Reynolds, Jr. |
| 5,107,612 | A | 4/1992 | Bechtel |
| 5,208,826 | A | 5/1993 | Kelly |
| 5,299,375 | A | 4/1994 | Thummel et al. |
| 5,323,555 | A | 6/1994 | Jehn |
| 5,388,364 | A | 2/1995 | Paldino |
| 5,430,967 | A | 7/1995 | Woodman, III et al. |
| 5,457,901 | A | 10/1995 | Gernstein et al. |
| 5,471,777 | A | 12/1995 | McDonald |
| 5,522,167 | A | 6/1996 | Teetzel |
| 5,581,898 | A | 12/1996 | Thummel |
| 5,584,137 | A | 12/1996 | Teetzel |
| 5,621,999 | A | 4/1997 | Moore |
| 5,628,555 | A | 5/1997 | Sharrah et al. |
| 5,654,594 | A | 8/1997 | Bjornsen, III et al. |
| 5,669,174 | A | 9/1997 | Teetzel |
| 5,758,448 | A | 6/1998 | Thummel |
| 5,768,819 | A | 6/1998 | Neal |
| 5,816,683 | A | 10/1998 | Christiansen |
| 5,930,935 | A | 8/1999 | Griffin |
| 6,023,875 | A | 2/2000 | Fell et al. |
| 6,378,237 | B1 | 4/2002 | Matthews et al. |
| 6,393,752 | B1 * | 5/2002 | Oliver et al. ..... 42/114 |
| 6,591,536 | B2 | 7/2003 | Houde-Walter et al. |
| 6,705,038 | B2 | 3/2004 | Davenport et al. |
| 2005/0115142 | A1 | 6/2005 | Kim |

* cited by examiner

*Primary Examiner*—Stephen M Johnson
(74) *Attorney, Agent, or Firm*—David Weiss

(57) ABSTRACT

An accessory mount or interface adapter having a rail for removably mounting an accessory (such as a light beam generator) to a firearm, the accessory mount being removably securable to a recurved trigger guard of a firearm without necessarily utilizing other structural features of the firearm for effecting the securement.

30 Claims, 3 Drawing Sheets

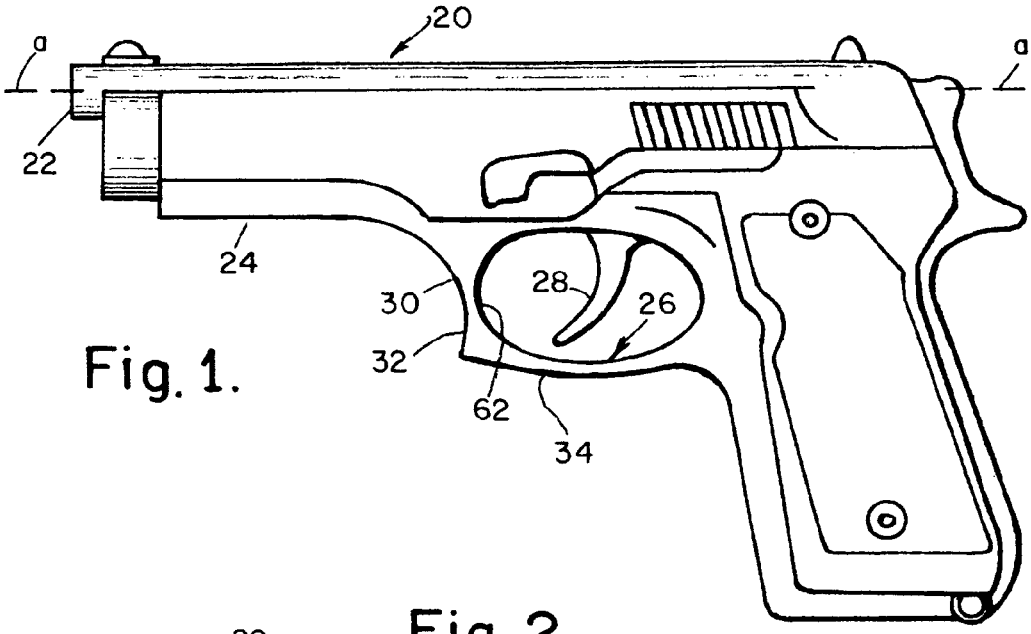
Fig. 1.
Fig. 2.
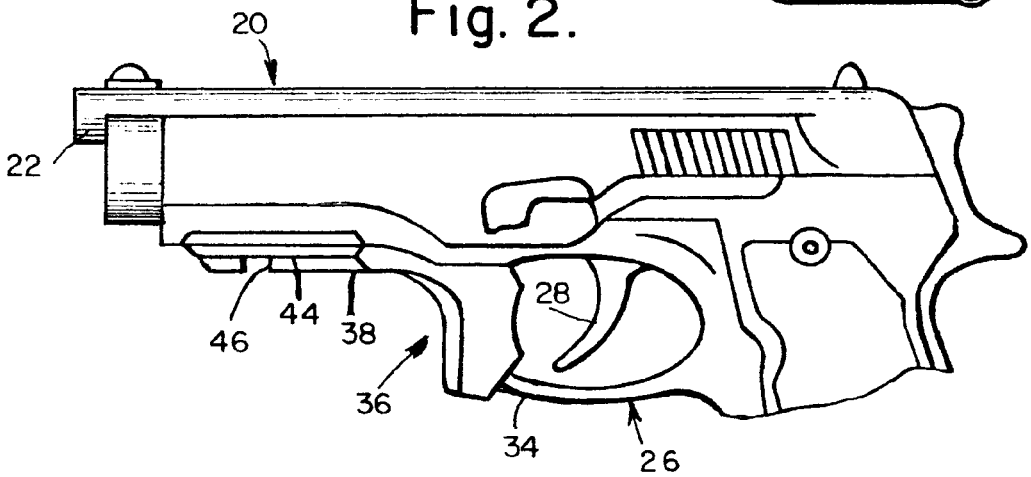
Fig. 3.
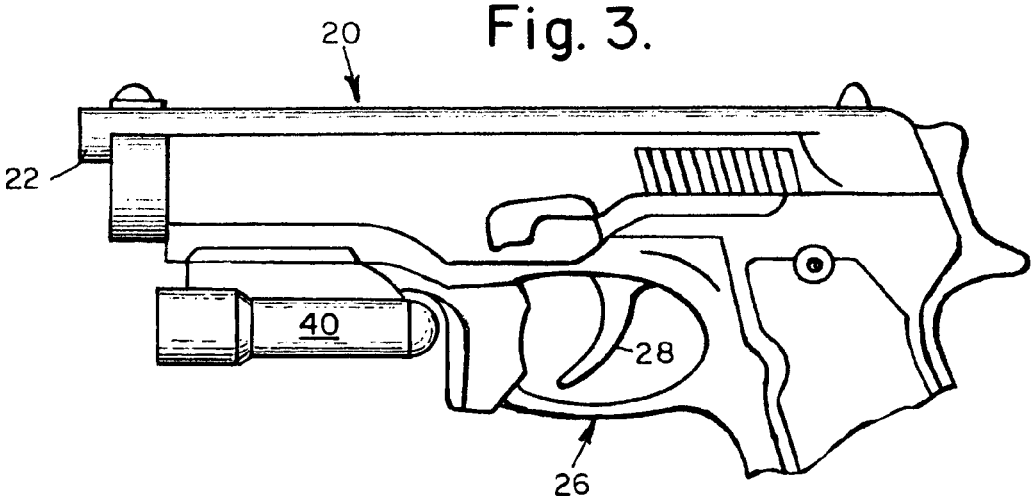

Fig. 4.
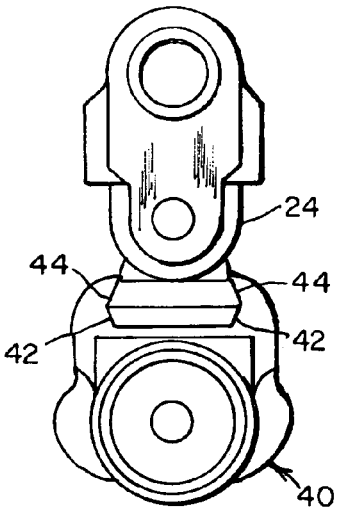
Fig. 5.
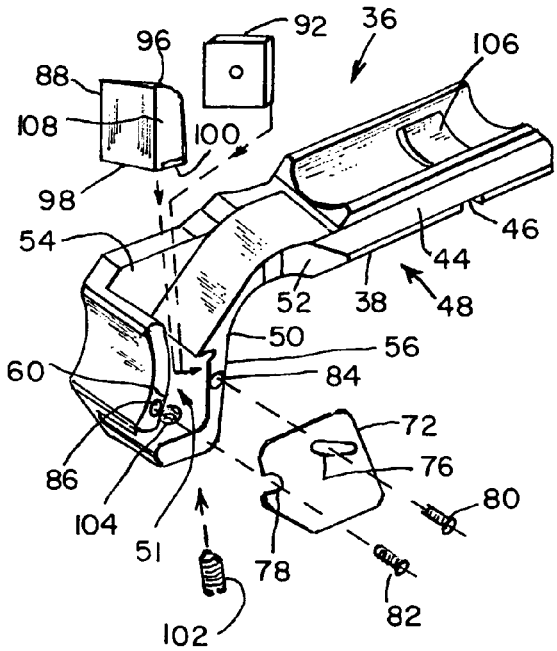
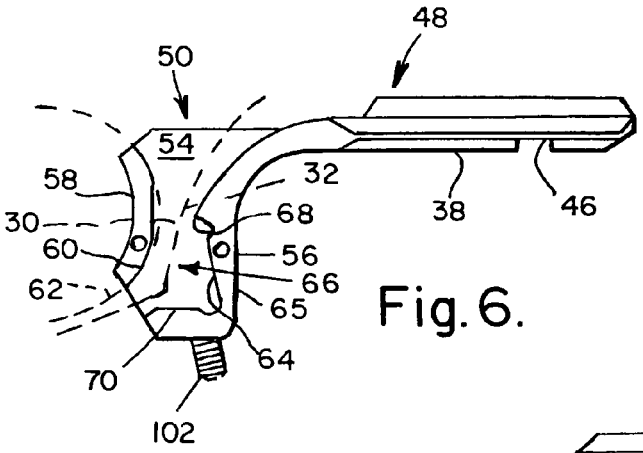
Fig. 6.
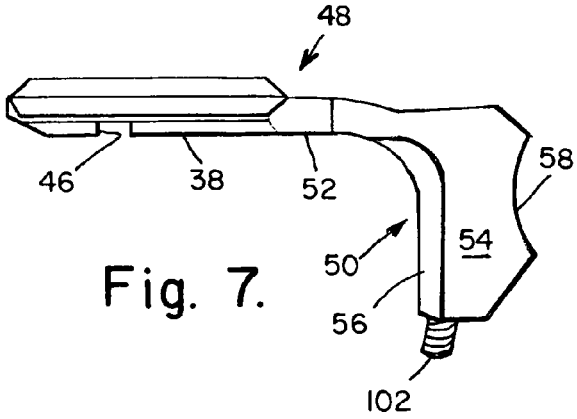
Fig. 7.

ACCESSORY MOUNT FOR A FIREARM

BACKGROUND OF THE INVENTION

This invention relates to accessory mounts for mounting an accessory to a firearm, and more particularly to a mount or interface adapter for securing a light beam generator apparatus to a firearm including a handgun.

Light beam generator apparatus, such as flashlights and laser aiming devices, have long been adapted for being secured to firearms as target illuminators and laser sights. For example, U.S. Pat. No. 4,777,754, issued to Edward C. Reynolds, Jr. and assigned to the assignee of the present invention, teaches a light beam generator assembly mounted to a firearm below the firearm's barrel and forwardly of the firearm's trigger guard. As applied to a handgun having a longitudinally moveable slide and a slide stop which causes the slide to lock open automatically after the last round has been fired and ejected, or which may be manually actuated at other times, the Reynolds light beam generating apparatus is pivotably secured to the handgun's slide stop pin transversely secured to the handgun frame. Positional stabilization of the secured light beam generator device on the handgun is facilitated by an adjustable set screw extending from the rear of the light beam generator housing and abutting the front surface of the handgun's trigger guard. Reynolds U.S. Pat. No. 4,777,754 is incorporated herein by reference.

U.S. Pat. No. 6,378,237, issued to John W. Matthews and Paul Y. Kim and assigned to the assignee of the present invention, discloses an accessory mount or interface adapter clamped to the front of the handgun's trigger guard and longitudinally extending beneath the handgun's barrel. The accessory mount includes a rail having a pair of longitudinal grooves, one along each side of the rail, and the light beam generator apparatus includes a pair of longitudinal tongues for slidably mating with the mount's longitudinal grooves for being slidably held along the rail. A latch on the light beam generator housing co-acts with a transverse slot in the rail to releasably prevent further longitudinal movement of the light beam generator apparatus when such apparatus is at a predetermined position along the rail. Matthews et al. U.S. Pat. No. 6,378,237 is incorporated herein by reference.

U.S. patent application Ser. No. 10/889,768, by Paul Y. Kim and assigned to the assignee of the present invention, published as U.S. Patent Application Publication No. US-2005-0115142-A1, discloses an accessory mount or interface adapter for mounting a rail mountable accessory (such as a light beam generator apparatus) to a firearm, which accessory mount is removably secured to the firearm through utilization of an improved slide stop and pin combination, and which accessory mount is positionally stabilized by utilization of a shock absorbing trigger guard bumper. In the preferred embodiment disclosed therein, a rearwardly spring-biased resilient bumper is carried by the accessory mount and rearwardly urged against the trigger guard. U.S. Patent Application Publication No. US-2005-0115142-A1 is incorporated herein by reference.

U.S. patent application Ser. No. 11/244,632, by Timothy F. La France and assigned to the assignee of the present invention, discloses an accessory mount or interface adapter having a rail for mounting a rail mountable accessory (such as a light beam generator apparatus) to a firearm, which accessory mount is removably secured to the firearm through utilization of a transverse pin retained by the firearm, and which accessory mount is positionally stabilized by utilization of a preferably elastomeric generally wedge shaped member urged between the mount and the firearm's trigger guard.

SUMMARY OF THE INVENTION

By the present invention, there is provided an accessory mount or interface adapter having a rail for mounting a rail mountable accessory (in particular a light beam generator apparatus) to a firearm. The preferred embodiment of the accessory mount is removably securable to a firearm having a recurved trigger guard, i.e. a trigger guard having a front section including a forward surface which curves or extends rearwardly (i.e. concave forward) of the curvature of the generally horizontal lower section of the trigger guard. The accessory mount preferred embodiment is directly securable to the recurved trigger guard without the necessity of utilizing other structural features of the firearm for effecting the securement.

According to a preferred embodiment of the present invention, there is provided an accessory mount for mounting an accessory device to a firearm, the firearm including a longitudinal barrel and a trigger guard with a recurved front section, the accessory mount comprising: a longitudinal rail adapted for removably securing the accessory device thereto; an appendage downwardly projecting from the rail in the vicinity of the rear end of the rail, the appendage including a first side wall, a front wall and a rear wall, the front wall and the rear wall spaced apart by an opening in the appendage for receiving the trigger guard recurved front section when the rail is placed to the firearm longitudinally beneath the barrel, the front wall configured to form a cavity with the trigger guard recurved front section and the first side wall; a cover plate secured to the appendage, the cover plate positionable for covering the opening and alternatively for uncovering the opening; and a resilient member configured for being received by the cavity and adapted to be wedged against the front wall and the trigger guard recurved front section. The cover plate forms a second side wall for the cavity when the cover plate is positioned for covering the opening, and the resilient member is fitted between the first and second side walls when contained in the cavity.

The appendage preferably includes a threaded bore and a set screw threadedly engaging the threaded bore for urging the resilient member to wedge against the front wall and the trigger guard recurved front section, and the resilient member includes a rigid base portion for interfacing with the set screw.

The front wall of the preferred appendage embodiment includes an upper rearward flange at the top of the cavity for upwardly restraining the resilient member when the resilient member is urged by the set screw, and the front wall includes a lower rearward flange at the bottom of the cavity, the lower rearward flange including the threaded bore and the set screw.

According to a further aspect of the present invention, there is provided a preferred embodiment of firearm and accessory mount apparatus comprising in combination: a firearm including a longitudinal barrel and a trigger guard with a recurved front section; a rail adapted for removably securing the accessory device thereto, the rail longitudinally extending beneath the barrel; an appendage downwardly projecting from the rail in the vicinity of the rear end of the rail, the appendage including a first side wall, a front wall and a rear wall, the front wall and the rear wall spaced apart by an opening in the appendage with the trigger guard recurved front section received in the appendage by the opening, the front wall configured to form a cavity with the trigger guard recurved front section and the first side wall; a cover plate secured to the appendage, the cover plate postionable for covering the opening and alternatively for uncovering the opening; and a resilient member in the cavity and wedged against the front wall and the trigger guard recurved front section with the cover plate covering the opening. The cover plate forms a second side wall for the cavity when the cover plate is positioned for covering the opening, and the resilient member is fitted between the first and second side walls.

The appendage includes a threaded bore and a set screw threadedly engaging the threaded bore for applying a force to the resilient member to wedge against the front wall and the trigger guard recurved front portion and for releasing the force from the resilient member. The resilient member preferably includes a rigid base portion for interfacing the set screw, and the front wall of the preferred appendage embodiment includes an upper rearward flange at the top of the cavity upwardly restraining the resilient member when the force is applied to the resilient member.

BRIEF DESCRIPTION OF THE DRAWINGS

The novel features believed to be characteristic of the present invention, together with further advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

FIG. 1 is a left side elevation view of a firearm having a trigger guard of a type suitable for use with an accessory mount or interface adapter in accordance with the present invention;

FIG. 2 is a fragmentary left side elevation view of the firearm of FIG. 1 with a preferred embodiment of an accessory mount or interface adapter according to the present invention secured thereto;

FIG. 3 is similar to FIG. 2, except that a light beam generator apparatus is shown mounted to the accessory mount;

FIG. 4 is a front elevation view of the firearm with secured accessory mount and light beam generator of FIG. 3, shown in increased scale;

FIG. 5 is an exploded perspective view of the preferred embodiment of the accessory mount or interface adapter shown in FIG. 2;

FIG. 6 is a right side elevation view of the adapter body and set screw of FIG. 5, as applied to a recurved trigger guard (shown fragmented and in phantom);

FIG. 7 is a left side elevation view of the apparatus of FIG. 6;

DETAILED DESCRIPTION OF THE PREFERRED EMBODIMENT

Figure 8:
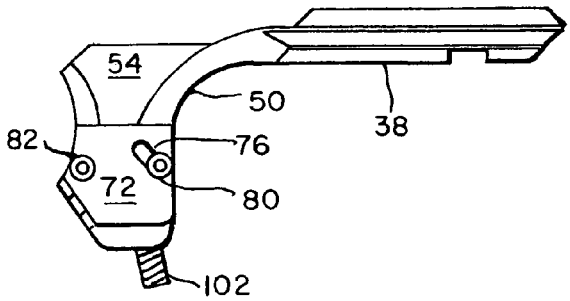
FIG. 8 is similar to FIG. 6 but includes the cover plate shown in FIG. 5 secured to the adapter body.

Turning to the drawings, there is illustrated in FIG. 1 an example of a firearm 20, specifically a Beretta model 92FS handgun. The firearm 20 includes a barrel 22 extending along a longitudinal axis a from the handgun's frame 24, and includes a trigger guard in front of the handgun's trigger 28.

As used herein, the word "longitudinal" describes a direction along or parallel to the axis a; "transverse" describes a horizontal direction perpendicular to the longitudinal direction when the barrel 22 is horizontally positioned; "above" means vertically above when the handgun 20 is held with its barrel 22 horizontal; "below" or "beneath" means vertically below when the handgun 20 is held with the barrel 22 horizontal; "front" or "forward" describes the direction toward the muzzle of the barrel from the trigger 28 (i.e., to the left as viewed in FIGS. 1-3 and 7, and to the right as viewed in FIGS. 5, 6, 8, 10 and 13); "rear" or "rearward" describes the direction opposite the front or forward direction; "left" means to the left when forwardly viewed from the rear of the firearm 20; and "right" means to the right when forwardly viewed from the rear of the firearm 20.

Handguns of the type shown in FIG. 1 include a recurved trigger guard, i.e. a trigger guard 26 having a front section 30 including a forward surface 32 which curves or extends rearwardly (i.e. concave forward) from the curvature of the generally horizontal lower section 34 of the trigger guard 26. The usual function of a recurved trigger guard is for accommodating a user's non-shooting hand in a two-hand hold of the handgun. The securement device of the preferred embodiment of the present invention utilizes the firearm's recurved trigger guard 26 for permitting the securement of an accessory mount or interface adapter 36 to the firearm 20 as represented in FIG. 2. The present invention is of particular advantage for quickly and detachably securing an accessory mount to a recurved trigger guard of a firearm without necessarily utilizing other structural features of the firearm for assisting in the securement.

When the accessory mount 36 is secured to the handgun 20, as represented in FIGS. 2-4, a rail 38 included by the accessory mount 36 longitudinally extends along the handgun frame 24 and beneath the barrel 22. After the accessory mount 36 has been installed on the handgun 20, a firearm accessory such as a light beam generator apparatus or light module 40 may be mounted to the accessory mount 36 as shown in FIGS. 3 and 4. For example, the light beam generator 40 may include a pair of longitudinal grooves 42 for slidably mating with respective longitudinal tongues 44 of the accessory mount's rail 38. A latch on the light beam generator housing may co-act with a transverse slot 46 in the rail 38 for releasably preventing further longitudinal movement of the light beam generator 40 along the rail 38 when the light beam generator 40 is at a predetermined position along the rail 38. Light beam generators of this type are shown in the aforementioned U.S. Pat. No. 6,378,237 incorporated herein by reference.

As shown in FIGS. 5-7, the longitudinal rail 38 comprises a portion of a mount body 48 which also includes an appendage 50 projecting downwardly from the rail 38 in the vicinity of the rear end 52 of the rail 38. The appendage 50 includes a side wall 54, a generally vertical front wall 56, and a rear wall 58 having a front surface 60 configured for engaging the rear surface 62 of the trigger guard's front section 30. The front wall 56 and the rear wall 58 are longitudinally spaced apart by an opening 51 in the appendage 50, through which the trigger guard's recurved front section 30 may be received and accommodated in the appendage 50 when the accessory mount 36 is placed to the firearm's frame 24 longitudinally beneath the barrel 22. The rear surface 64 of the front wall 56 is configured to form a cavity 66 with the recurved forward surface 32 of the trigger guard's front section 30 (shown in phantom in FIG. 6) and the appendage side wall 54 when the recurved trigger guard front section 30 is received by the appendage 50 of the accessory mount body 48.

The rear surface 64 of the front wall 56 is preferably rearwardly and upwardly inclined, for example by about 6° from the front wall's generally vertical forward surface 65. In the preferred embodiment, the front wall 56 includes an upper rearward flange 68, which may be upwardly and rearwardly inclined, say by about 6°, defining the top of the cavity 66. The front wall 56 also preferably includes a lower rearward flange 70 defining the bottom of the cavity 66.

A cover plate 72 is adapted to be secured to the appendage 50, for covering the opening 51 and forming a second side wall for the cavity 66. As shown in FIGS. 5 and 8, an example of the cover plate 72 includes an elongated aperture 76 and a notch 78, with headed screws 80, 82 respectively extending through the elongated aperture 76 and notch 78 and engaging transverse threaded apertures 84 and 86 respectively in the front and rear walls 56, 58. The cover plate 72 is slidable along the elongated aperture 76 for removing the notch 78 from the secured screw 82, so that the plate may be pivoted about the screw 80 for uncovering the opening 51 in the appendage 50 through which the trigger guard's recurved front section 30 may be received in the appendage 50 and through which the trigger guard's recurved front section 30 may be removed from the appendage 50. The width or transverse dimension of the appendage interior formed by the walls 54, 56, 58, 74 is approximately the same as the width or transverse dimension of the trigger guard recurved front section 30, and the trigger guard recurved front section 30 is captured by the appendage 50 when the plate 72 is in its fully secured condition covering the opening 51 in the appendage 50.

Figure 11:
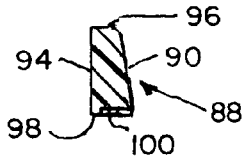
FIG. 11 is a vertical cross-sectional view of the resilient member shown in FIG. 5.
Figure 12:
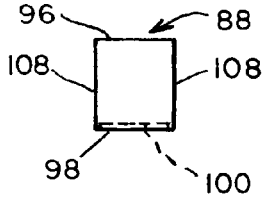
FIG. 12 is a front elevation view of the resilient member shown in FIGS. 5 and 11.

As represented in FIGS. 5, 11 and 12, the accessory mount 36 includes a resilient member 88 sized for being received by the cavity 66 and preferably fitted between and contacting the side walls 54, 74 when the resilient member 88 is contained in the cavity 66. The resilient member 88 is preferably generally block-shaped, having a front face 90 for engaging the front wall 56 (either by directly contacting the front wall's rear surface 64 or by contacting a shim 92 interposed between the front wall rear surface 64 and the resilient block 88), a rear face 94 for engaging the recurved forward surface 32 of the trigger guard's front section 30, a top face 96 at least partially engaging the front wall's upper rearward flange 68, and a base 98 adjacent to and facing the front wall's lower rearward flange 70. The resilient block's rear face 94 is preferably upwardly forwardly inclined by an angle approximately similar to the angle of inclination of the front wall's rear surface 64, for example about 6°.

The resilient block 88 preferably comprises an elastomeric member having a rigid base portion. For example, the resilient block 88 may be comprised of an elastomeric material (two examples of which are a polymeric elastomer and neoprene), to which a rigid plate 100 (such as a hardened steel plate) is retained along the base 98. The appendage 50 further includes a set screw 102 threadedly retained by a threaded bore 104 through the front wall 56, preferably through the front wall's lower rearward flange 70 and midway between the inner surfaces of the side walls 54, 74, such that threading adjustment of the set screw 102 by a user will cause the tip of the set screw 102 to contact a central portion of the rigid base plate 100 when the resilient block 88 is contained in the cavity 66.

When installing the accessory mount 36 to the handgun 20, a user assures that the cover plate 72 is in its open position, i.e. the cover plate 72 is pivoted about the screw 80 for uncovering the opening 51 and permitting accessibility to the interior of the appendage 50 through the opening 51. The mount body 48 is applied to the handgun 20 such that the handgun's trigger guard recurved front section 30 is received through the appendage opening 51 uncovered by the pivoted cover plate 72, with the rear surface 62 of the trigger guard's front section 30 engaging the forward surface 60 of the appendage's rear wall 58, and with the mount body rail 38 longitudinally extending beneath the handgun's barrel 22. A spacer 106, for example a pad of preferably resilient material such as neoprene, may be secured to the upper surface of the rail 38 for engaging the lower surface of the handgun frame 24, for spacing such frame surface from the upper surface of the rail 38 and for providing a cushion therebetween.

Figure 9:
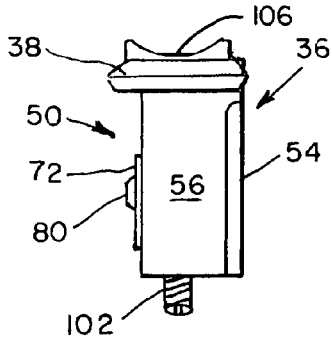
FIG. 9 is a front elevation view of the apparatus of FIG. 8.
Figure 10:
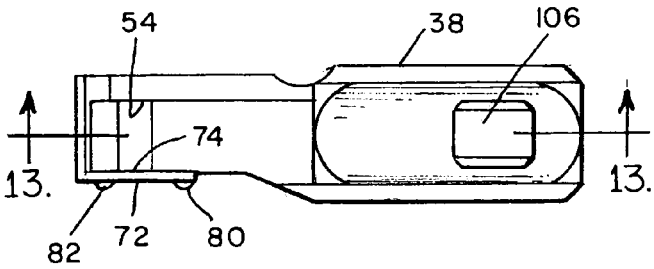
FIG. 10 is a top plan view of the apparatus of FIG. 8.

The user places the resilient block 88 into the cavity 66, with the front face 90 of the block 88 facing the appendage's front wall 56, the block's top face 96 facing the appendage's upper rearward flange 68, the block's rear face 94 facing the trigger guard recurved front section 30, and the block's base 98 facing the appendage's lower rearward flange. As earlier noted, a shim 92 may be interposed between the resilient block 88 and rear surface 64 of the appendage's front wall 56. The cover plate 72 is then pivoted about the screw 80 and manipulated such that the cover plate's notch 78 engages the screw 82, whereupon the cover plate 72 is in its closed position (represented in FIGS. 8-10) covering the opening 51, causing the trigger guard's recurved front section 30 to be captured within the appendage 50 and providing the second side wall 74 of the cavity 66.

Figure 13:
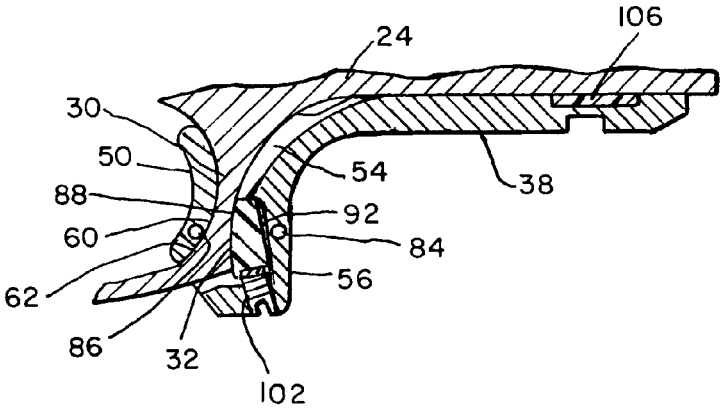
FIG. 13 is a cross-sectional view of the accessory mount or interface adapter of FIG. 5, taken along the line 13-13 of FIG. 10 and viewed in the direction of the appended arrows, shown installed on the frame (represented in fragmentary cross-section) of a firearm as in FIG. 2.

The user thereupon threadingly adjusts the set screw 102 by rotating the set screw 102 such as with the rim of a cartridge inserted in a slot 103 of the set screw, causing the tip of the set screw 102 to contact and to apply a generally upward force to the resilient block's rigid base 98 (i.e. the base plate 100), urging the resilient block's base 98 generally upwardly into the cavity 66 and causing the resilient block 88 to wedge against the front wall 56 and the recurved forward surface 32 of the trigger guard's front section 30 while the resilient block's top 96 is being retained by and urged against the front wall's upper rearward flange 68 and the block's sides 108 are being retained by and urged against the side walls 54, 74. Such wedging entrapment of the resilient block 88 to the captured recurved trigger guard section 30, securely holding the accessory mount 36 to the handgun's trigger guard with the accessory mount's rail 38 longitudinally along the handgun's frame 24, is shown in FIG. 13. Further, while the resilient block 96 is urged by the set screw 102, elastomeric material at the side 108 of the resilient block 96 forced against the side wall 74 tends to extrude into the elongated aperture 76 of the cover plate 72, restraining the cover plate 72 against movement which may otherwise uncover the opening 51.

For removing the accessory mount 36 from the firearm 20, the user partially unscrews the set screw 102, releasing the generally upward force to the resilient block 88, causing the resilient block 88 to reassume its non-stressed configuration and to be disengaged from the recurved forward surface 32 of the trigger guard's front section 32. The user then pivotally manipulates the cover plate 72 about the screw 80 until the cover plate 72 is in its open position uncovering the opening 51. At this point, the user manipulates the mount body 48 transversely away from the trigger guard 26 for effectively causing the trigger guard recurved front section 30 to be passed through the opening 51 provided by the open cover plate 72, whereupon the user may remove the accessory mount 36 from the handgun 20.

The accessory mount body 48 of the present invention may be made using fabrication methods well known in the art, of well known materials typically used in the art of making firearm accessory mounts including rigid and durable materials such as polymeric materials as well as metals such as aluminum alloys.

Thus, there has been described a preferred embodiment of an accessory mount removably securable to a recurved trigger guard of a firearm. Other embodiments of the present invention, and variations of the embodiment described herein, may be developed without departing from the essential characteristics thereof. Accordingly, the invention should be limited only by the scope of the claims set forth below.

We claim:

1. An accessory mount for mounting an accessory device to a firearm, the firearm including a longitudinal barrel and a trigger guard with a recurved front section, the accessory mount comprising:

a longitudinal rail adapted for removably securing the accessory device thereto;

an appendage downwardly projecting from said rail in the vicinity of the rear end of said rail, said appendage including a first side wall, a front wall and a rear wall, said front wall and said rear wall spaced apart by an opening in said appendage for receiving the trigger guard recurved front section when said rail is placed to the firearm longitudinally beneath the barrel, said front wall configured to form a cavity with the trigger guard recurved front section and said first side wall;

a cover plate secured to said appendage, said cover plate positionable for covering said opening and alternatively for uncovering said opening; and a resilient member configured for being received by said cavity and adapted to be wedged against said front wall and the trigger guard recurved front section.

2. The accessory mount according to claim 1, wherein:

said cover plate forms a second side wall for said cavity when said cover plate is positioned for covering said opening.

3. The accessory mount according to claim 2, wherein:

said resilient member is fitted between said first and second side walls when contained in said cavity.

4. The accessory mount according to claim 1, wherein:

said appendage includes a threaded bore and a set screw threadedly engaging said threaded bore for urging said resilient member to wedge against said front wall and the trigger guard recurved front section.

5. The accessory mount according to claim 4, wherein:

said resilient member includes a rigid base portion for interfacing with said set screw.

6. The accessory mount according to claim 4, wherein:

said front wall includes an upper rearward flange at the top of said cavity for upwardly restraining said resilient member when said resilient member is urged by said set screw.

7. The accessory mount according to claim 4, wherein:

said front wall includes a lower rearward flange at the bottom of said cavity, said lower rearward flange including said threaded bore.

8. The accessory mount according to claim 7, wherein:

said front wall includes an upper rearward flange at the top of said cavity for upwardly restraining said resilient member when said resilient member is urged by said set screw.

9. The accessory mount according to claim 3, wherein:

said cover plate includes an aperture adapted to receive material from said resilient member when said resilient member is wedged against said front wall and said trigger guard recurved front section.

10. The accessory mount according to claim 3, wherein:

said appendage includes a threaded bore and a set screw threadedly engaging said threaded bore for urging said resilient member to wedge against said front wall and the trigger guard recurved front section.

11. The accessory mount according to claim 10, wherein:

said resilient member includes a rigid base portion for interfacing with said set screw.

12. The accessory mount according to claim 10, wherein:

said front wall includes an upper rearward flange at the top of said cavity for upwardly restraining said resilient member when said resilient member is urged by said set screw.

13. The accessory mount according to claim 10, wherein:

said front wall includes a lower rearward flange at the bottom of said cavity, said lower rearward flange including said threaded bore.

14. The accessory mount according to claim 13, wherein:

said front wall includes an upper rearward flange at the top of said cavity for upwardly restraining said resilient member when said resilient member is urged by said set screw.

15. The accessory mount according to claim 14, wherein:

said cover plate includes an aperture adapted to receive material from said resilient member when said resilient member is urged by said set screw.

16. Firearm and accessory mount apparatus, comprising in combination:

a firearm including a longitudinal barrel and a trigger guard with a recurved front section;

a rail adapted for removably securing the accessory device thereto, said rail longitudinally extending beneath said barrel;

an appendage downwardly projecting from said rail in the vicinity of the rear end of said rail, said appendage including a first side wall, a front wall and a rear wall, said front wall and said rear wall spaced apart by an opening in said appendage with said the trigger guard recurved front section received in said appendage by said opening, said front wall configured to form a cavity with the trigger guard recurved front section and said first side wall;

a cover plate secured to said appendage, said cover plate positionable for covering and alternatively for uncovering said opening; and a resilient member in said cavity and wedged against said front wall and said trigger guard recurved front section with said cover plate covering said opening.

17. The apparatus according to claim 16, wherein:

said cover plate forms a second side wall for said cavity when said cover plate is positioned for covering said opening.

18. The apparatus according to claim 17, wherein:

said resilient member is fitted between said first and second side walls.

19. The apparatus according to claim 16, wherein:

said appendage includes a threaded bore and a set screw threadedly engaging said threaded bore for applying a force to said resilient member to wedge against said front wall and the trigger guard recurved front portion and for releasing said force from said resilient member.

20. The apparatus according to claim 19, wherein:

said resilient member includes a rigid base portion for interfacing with said set screw.

21. The apparatus according to claim 19, wherein:

said front wall includes an upper rearward flange at the top of said cavity upwardly restraining said resilient member when said force is applied to said resilient member.

22. The apparatus according to claim 19, wherein:

said front wall includes a lower rearward flange at the bottom of said cavity, said lower rearward flange including said threaded bore and said set screw.

23. The apparatus according to claim 22, wherein:

said front wall includes an upper rearward flange at the top of said cavity for upwardly restraining said resilient member when said force is applied to said resilient member.

24. The apparatus according to claim 18, wherein:

said cover plate includes an aperture receiving material from said resilient member when said resilient member is wedged against said front wall and said trigger guard recurved front section with said cover plate covering said opening.

25. The apparatus according to claim 18, wherein:

said appendage includes a threaded bore and a set screw threadedly engaging said threaded bore for applying a force to said resilient member to wedge against said front wall and the trigger guard recurved front portion and for releasing said force from said resilient member.

26. The apparatus according to claim 25, wherein:

said resilient member includes a rigid base portion for interfacing with said set screw.

27. The apparatus according to claim 25, wherein:

said front wall includes an upper rearward flange at the top of said cavity upwardly restraining said resilient member when said force is applied to said resilient member.

28. The apparatus according to claim 25, wherein:

said front wall includes a lower rearward flange at the bottom of said cavity, said lower rearward flange including said threaded bore and said set screw.

29. The apparatus according to claim 28, wherein:

said front wall includes an upper rearward flange at the top of said cavity for upwardly restraining said resilient member when said force is applied to said resilient member.

30. The apparatus according to claim 29, wherein:

said cover plate includes an aperture receiving material from said resilient member when said resilient member is urged by said set screw with said cover plate covering said opening.

* * * * *